US006561771B2

(12) United States Patent
Keyster et al.

(10) Patent No.: US 6,561,771 B2
(45) Date of Patent: May 13, 2003

(54) AXIAL PISTON PUMP WITH CENTER INLET FILL

(75) Inventors: Eric S. Keyster, Peoria, IL (US); Dennis Gibson, Chillicothe, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/884,748

(22) Filed: Jun. 19, 2001

(65) Prior Publication Data

US 2002/0192083 A1 Dec. 19, 2002

(51) Int. Cl.[7] ..... F04B 1/12; F04B 27/08

(52) U.S. Cl. ..... 417/269; 417/284; 92/12.2

(58) Field of Search ..... 417/269, 213, 417/222.1, 284, 440, 63; 92/71, 12.1, 12.2, 13.1, 13.4

(56) References Cited

U.S. PATENT DOCUMENTS 4,077,305 A * 3/1978 Stuhr ..... 91/486
5,603,609 A 2/1997 Kadlicko
6,035,828 A * 3/2000 Anderson et al. ..... 123/446
6,176,684 B1 * 1/2001 Zimmermann ..... 417/222.1
6,250,204 B1 * 6/2001 Kuhn et al. ..... 92/12.2
6,354,186 B1 * 3/2002 Gibson et al. ..... 92/71

FOREIGN PATENT DOCUMENTS

DE 34 37 949 A1 * 4/1986
WO WO 97/47883 12/1997

* cited by examiner

*Primary Examiner*—Charles G. Freay
*Assistant Examiner*—Han L. Liu
(74) *Attorney, Agent, or Firm*—Liell & McNeil

(57) ABSTRACT

An axial piston pump with center inlet fill utilizes a hydrostatic thrust bearing and a hydrodynamic journal bearing to support a rotating wobble type drive plate connected to a drive shaft. The rotation of the drive plate causes a plurality of parallel pistons to reciprocate up and down. The pumping chambers of a portion of the pistons are fluidly connected via a center fill passage to the inlet defined by the pump housing. Simultaneously, the pumping chambers of a different portion of the pistons are fluidly connected to the outlet via a high pressure actuation fluid outlet passage. The center fill passage exploits centrifugal forces to assist, rather than resist, the supply of low pressure fluid to the pistons, especially when rotating at higher speeds.

20 Claims, 2 Drawing Sheets

AXIAL PISTON PUMP WITH CENTER INLET FILL

TECHNICAL FIELD

This invention relates generally to axial piston pumps, and more particularly to drive plates for axial piston pumps.

BACKGROUND

In several diesel engines today, fixed displacement actuation fluid pumps supply high pressure actuation fluid to hydraulically-actuated systems within the engine. Typically, fixed displacement pumps such as that shown in U.S. Pat. No. 6,035,828 entitled Hydraulically-Actuated System Having A Variable Delivery Fixed Displacement Pump, which issued to Anderson et. al. on Mar. 14, 2000, consist of a rotating wobble type drive plate connected to the drive shaft. The rotation of the drive plate causes a plurality of parallel pistons to reciprocate up and down. Low pressure actuation fluid (e.g., lubricating oil) flows through windows in the radial outer surface of a drive plate and travels radially inward to the pistons in order to be pressurized. In order to balance the load of the reciprocating pistons and to limit the friction between the drive plate and the pump housing, tapered roller bearings are placed between the drive plate and the pump housing.

While fixed displacement pumps have performed adequately, there is room for improvement. For instance, it is known in the art that a reduction in the number of engine components can make the engine more robust. Further, engineers have found that the rotating drive shaft and drive plate cause centrifugal forces that act against the flow of fluid to the pistons. Thus, at higher speeds where centrifugal forces are greater and at cold temperatures where the viscosity of the pumped fluid, particularly lubricating oil, is relatively high, pump efficiency is reduced.

The present invention is directed to overcoming one or more of the problems as set forth above.

SUMMARY OF THE INVENTION

In one aspect of the present invention, a drive plate for an axial piston pump includes a metallic component that has a centerline. The metallic component has a radial inner surface surrounding the centerline and a drive surface oriented at a drive angle that is different from 90° relative to the centerline. The metallic component also defines a center fill passage extending from the radial inner surface through the drive surface.

In another aspect of the present invention, a pump has a housing defining an inlet and includes a plurality of pistons arranged around a centerline. Each piston defines a hollow interior. The pump also has a rotatable drive plate having a radial inner surface that defines a supply opening. The hollow interior of at least one of the plurality of pistons is in fluid communication with the inlet via the supply opening.

In yet another aspect of the present invention, a method of pumping fluid includes a step of reciprocating a plurality of pistons at least in part by rotating a drive plate. A pumping chamber of a portion of the pistons is fluidly connected to the inlet via a center fill passage extending between a radial inner surface and a drive surface of a drive plate. The pumping chamber of a different portion of the pistons is fluidly connected to an outlet.

DETAILED DESCRIPTION

Figure 1:
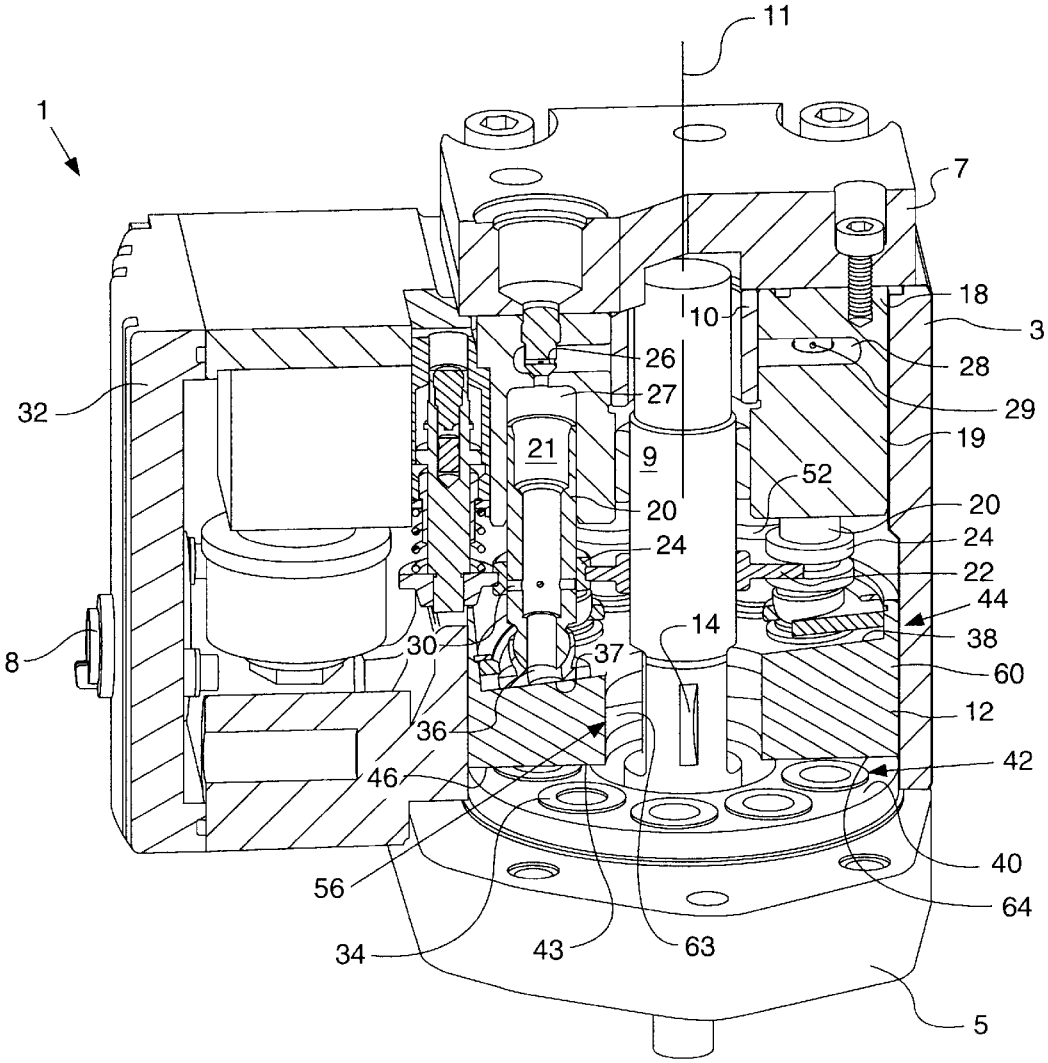
FIG. 1 is a combination perspective and cross-sectional diagrammatic view of an axial piston pump according to the invention.

Referring to FIG. 1, there is shown an axial piston pump 1 according to the present invention. The various features, including the drive plate 12, of axial piston pump 1 are contained within the pump housing 3 between a front flange 5 and an end cap 7. Housing 3 defines an inlet 8 that would be connected to a source of low pressure fluid, such as lubricating oil. Inlet 8 opens into a low pressure interior 52. A drive shaft 9, which is driven by an engine (not shown), extends into the axial piston pump 1, supported by a bearing collar 10. The drive shaft 9 in this embodiment is connected with a wobble plate type drive plate 12 in a keyway drive configuration in which a key (not shown) fits into a drive shaft slot 14 and a drive plate slot in the drive plate 12. Other configurations utilizing the invention are possible, but a keyway drive or other configuration that allow the drive plate 12 to rotate nonrigidly is preferred.

A barrel assembly 18 consisting of a barrel 19 and bearing collar 10 is bolted to the end cap 7. Barrel assembly 18 holds a number of pistons 20 (nine in this embodiment). The effectiveness of pistons 20 is coupled by an output control connector 22. The plurality of pistons 20 are arranged around a centerline 11 and are oriented parallel to the centerline 11. Each of the pistons 20 define a pumping chamber 27 and a hollow interior 21, which includes an opening 37 through one end. Each piston 20 is slidably held within a respective sleeve 24, which is attached to connector 22. A one-way outlet check valve 26 in barrel 19 above the top end of each piston 20 allows compressed actuation fluid to exit each pumping chamber 27 into a collector ring 28 of high pressure actuation fluid. Fluid leaves axial piston pump 1 from collector ring 28 via one or more high-pressure outlet passages 29. As the drive plate 12 rotates, a portion of the pistons 20 are in fluid communication with the outlet via the one or more outlet passages 29. Although other variable actuation fluids could be used, the present invention preferably utilizes engine lubrication oil as its pumped fluid.

Spill ports 30 are defined by each piston 20 in the area of its respective sleeve 24. An electro-hydraulic control unit 32 can control the vertical position of each sleeve 24 on its respective piston 20 by adjusting a vertical position of the output control connector 22. This controls the discharge of the pump 1 by selectively allowing the sleeves 24 to cover or uncover the spill ports 30 during a variable portion of each piston's pumping stroke.

Each piston 20 is connected to a respective piston shoe 34 by means of a flexible joint, a ball joint 36 for example, so that the piston shoes 34 can conform to the slanted drive surface 38 of the drive plate 12 as it rotates. A base surface 64 of the drive plate 12 in turn rests against a hydrostatic thrust bearing plate 40 on the front flange 5. The hydrostatic thrust bearing plate 40 comprises a number of thrust pads 42, each positioned directly beneath a respective one of the pistons 20.

Figure 4:
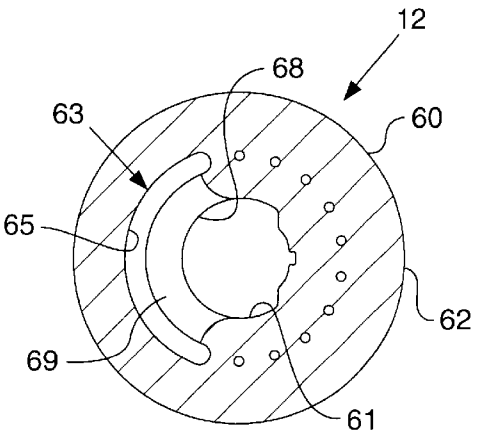
FIG. 4 is a sectioned bottom view of the drive plate in FIGS. 2 and 3 along section line C—C of FIG. 3.
Figure 3:
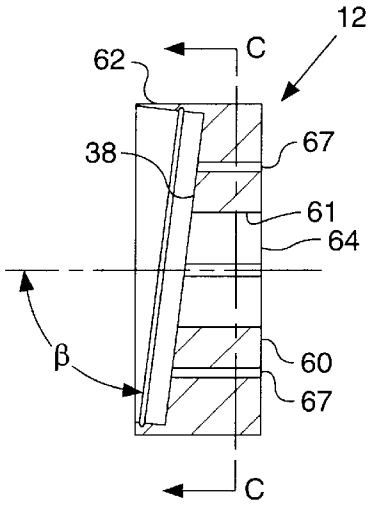
FIG. 3 is a sectioned side view of the drive plate in FIG. 2 as viewed along section line A—A.
Figure 2:
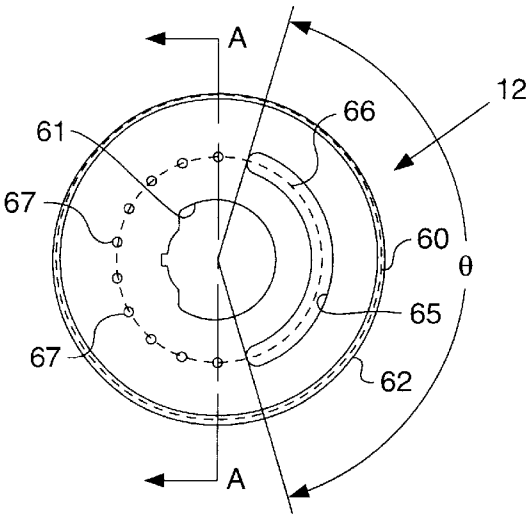
FIG. 2 is a front view of a drive plate according to the invention.

Referring now in addition to FIGS. 2–4, the drive plate 12 defines a plurality of bearing supply passages 67 that extend from the base surface 64 through the slanted drive surface 38. The bearing supply passages 67, along with a fill slot 65, are distributed on a circle 66 centered on the centerline 11

(as shown in FIGS. 2 and 4). A portion of the fluid pumped by each piston 20 is displaced via the bearing supply passages 67 to the area between the base surface 64 and the thrust pads 42 to provide a hydrostatic thrust bearing 43. The fluid then migrates into the area between housing 3 and the radial outer surface 62 to form a hydrodynamic journal bearing 44 between the drive plate 12 and the housing 3 as the drive plate 12 rotates.

Referring to FIGS. 2–4, there are shown several views of the drive plate 12. The drive plate 12 of the axial piston pump 1 is comprised of a metallic component 60 having a centerline 11. Metallic component 60 of drive plate 12 is machined in a conventional manner to include a slanted drive surface 38 and a base surface 64, located opposite of one another. Whereas the slanted drive surface 38 is oriented at a drive angle β which is different from 90° relative to the centerline 11, the base surface 64 is in a plane substantially perpendicular to the centerline 11 (as shown in FIG. 3). As the drive plate 12 rotates, the slanted drive surface 38 causes the plurality of pistons 20 to reciprocate up and down. Those skilled in the art will recognize that the slant angle and the piston diameters define the displacement capacity of pump 1.

The base surface 64 of the metallic component 60 separates the radial inner surface 61 from the radial outer surface 62. The radial outer surface 62 has a cylindrical shape with a diameter slightly smaller than housing 3, and the radial inner surface 61 defines the center fill passage 63 that extends from the radial inner surface 61 of metallic component 60 through the slanted drive surface 38. The center fill passage 63 consists of the arcuate fill slot 65 and a supply slot 69, which includes the supply opening 68. The supply slot 69 extends radially outward from the radial inner surface 61 and is contained within an angle θ of less than 180° about the centerline 11. Likewise, fill slot 65 sweeps out an arc with angle θ that is less than a 180° portion of circle 66. As the drive plate 12 rotates, inlet 8 is in fluid communication with the hollow interiors 21 and the pumping chambers 27 of the portion of the pistons 20 that have their end openings 37 (as shown in FIG. 1) located over fill slot 65.

INDUSTRIAL APPLICABILITY

Referring to FIG. 1, the keyway drive or other nonrigid rotation drive arrangement allows the drive shaft 9 to rotate the drive plate 12 in a nonrigid manner. Because the slanted drive surface 38 is orientated at a drive angle β that is different than 90° relative to the centerline 11, the rotation of the drive plate 12 causes the plurality of pistons 20 to reciprocate up and down. The pistons 20 are connected by a ball joint 36 with piston shoes 34 that engage the drive plate 12. Thus, as the drive plate 12 rotates, a portion of the pistons 20 are undergoing the pumping portion of their stroke and are compressing actuation fluid in their pumping chambers 27. Simultaneously, a different portion of the pistons 20 are undergoing the retracting portion of their stroke and are drawing low pressure actuation fluid into the their respective hollow interior 21 and pumping chamber 27 from low pressure interior 52 via center fill passage 63. Thus, as the drive plate 12 rotates, fill slot 65 passes underneath a portion of the pistons 20 while the bearing supply passages 67 passes underneath the end opening 37 of a different portion of the pistons 20.

For those pistons 20 undergoing their retracting stroke, inlet 8 is in fluid communication with their hollow interiors 21 via the center fill passage 63, which includes the fill slot 65, the supply slot 69 and the supply opening 68. Because the fill slot 65 and the supply slot 69 extend radially outward from said radial inner surface 61 of the metallic component 60 through the slanted drive surface 38, low pressure actuation fluid flows from the center fill passage 63 radially outward to the pistons 20. As the drive plate 12 rotates, the fill slot 65 passes underneath the portion of the pistons 20 that are undergoing the retracting portion of their stroke. The low pressure actuation fluid is drawn into the hollow interiors 21 of the pistons 20 and the pumping chambers 27 via the fill slot 65, the supply slot 68, and the supply opening 69.

While the hollow interiors 21 of a portion of the pistons 20 are in fluid communication with the inlet 8, a different portion of the pistons 20 are in fluid communication with the outlet passage 29. As the drive plate 12 continues to rotate, a different portion of the pistons 20 are undergoing the pumping portion of their stroke. This movement begins to compress fluid against the action of their return springs, causing some of the low pressure actuation fluid within the pumping chambers 27 to be pressurized, provided that sleeves 24 are covering spill holes 30. Recall that the electro-hydraulic control unit 32 can control the position of the sleeves 24 over the spill ports 30. Pressure within the pumping chambers 27 can only build when the spill ports 30 are covered by the sleeves 24. By uncovering the spill ports 30, the pressure will drain from the pistons 20. By covering the spill ports 30, the pistons 20 will be able to pressurize the actuation fluid in the pumping chambers 27. Thus, the sleeves 24 control the output of high pressure actuation fluid. The pressurized actuation fluid in the pumping chambers 27 can pass through the outlet check valves 26 into the collector ring 28 and hence to the pump output via the high-pressure outlet passage 29.

During the pumping portion of the stroke of the pistons 20, not all of the fluid will be compressed within the pumping chamber 27. For instance, when spill holes 30 are uncovered by sleeve 24, the fluid remains at a relatively low pressure and is merely displaced from pump chamber 27 back to low pressure interior 52 from where it came. When spill holes 30 are covered, fluid will be forced through the hollow interior 21 of the pistons 20 to the bearing supply passages 67 defined by the metallic component 60 of the drive plate 12. Because the bearing supply passages 67 extend from the base surface 64 of the drive plate 12 through the slanted drive surface 38, the actuation fluid can form a fluid film between the base surface 64 of the drive plate 12 and the thrust pads 42, creating a hydrostatic thrust bearing 43 that lifts the rotating base surface 64 out of contact with pump housing 3. Those skilled in the art will appreciate that the diameter of the bearing supply passages 67 must be such that enough actuation fluid can be forced through the drive plate 12 to create a hydrostatic thrust bearing 43 between the base surface 64 and the housing 3 while not allowing too much actuation fluid to flow from the system to the hydrostatic thrust bearing 43 between the base surface 64 and the housing 3. Too much flow to the thrust bearing 43 would unnecessarily diminish the output potential of the pump. A portion of the fluid from thrust bearing 43 flows back toward the low pressure interior 52 via the space between the radial outer surface 62 and housing 3 to produce a hydrodynamic journal bearing 44.

It should be appreciated that with every complete rotation of the drive plate 12, each piston 20 will undergo a complete stroke. Moreover, as the drive plate 12 rotates, there will always be at least one piston 20 in fluid communication with inlet 8, while at least one different piston 20 is in fluid communication with outlet passage 29.

The present invention decreases the energy needed to move actuation fluid from the inlet 8 to the pumping chambers 27 of the plurality of pistons 20 in order to be pressurized. Recalling in the prior art, the actuation fluid would flow through inlet passages on the radial outer surface of the drive plate inwards to the pistons via supply openings in the drive plate. In order for the actuation fluid to flow to the pistons, the system had to overcome the centrifugal forces caused by the rotating drive plate. In the present invention, the inlet passages, i.e., fill slot 65 and supply slot 69, are moved to the radial inner surface 61 and extend outward through the slanted drive surface 38. The actuation fluid flows through the center fill passage 63 outward through the fill slot 65 and supply slot 69 to the pistons 20 for pressurization. Thus, the centrifugal forces created by the rotating drive plate 12 assist, rather than resist, the actuation fluid moving to the pistons 20. By using the centrifugal forces to assist in pumping the actuation fluid, pump efficiency is improved at higher pump speeds where centrifugal forces are greater and during cold starts when the actuation fluid has a relatively higher viscosity.

The present invention also eliminates the need for tapered roller bearings between the base surface 64 of the drive plate 12 and the pumping housing 3. The bearing supply passages 67 that extend through the slanted drive surface 38 to the base surface 64 of the drive plate 12 allow a portion of the fluid which is compressed during the power portion of the stroke to form a hydrostatic thrust bearing 43 between the rotating base surface 64 of the drive plate 12 and the pump housing 3. Further, by utilizing the center fill passage 63 rather than placing inlets on the outer radial surface of the drive plate 12, the actuation fluid in the low pressure interior 52 need not flow into the drive plate 12 via the inlets on the outer radial surface. The reduced clearance between the drive plate 12 and the housing interior provides the ability to form a hydrodynamic journal bearing 44 between the rotating outer radial surface 62 of the drive plate 12 and the pump housing 3 while ensuring an adequate flow of fluid there between. Finally, by reducing the number of components needed, especially by eliminating metallic bearings, the pump becomes more robust and less expensive.

The above description is intended for illustrative purposes only, and is not intended to limit the scope of the present invention in any way. Those skilled in the art will appreciate that various modifications can be made to the illustrated embodiment without departing from the spirit and scope of the present invention, which is recited in the claims set forth below. Thus, those skilled in the art will appreciate that other aspects, objects and advantages of this invention can be obtained from a study of the drawings, the disclosure and the appended claims.

What is claimed is:

1. A drive plate for an axial piston pump comprising:

a metallic component having a centerline, a drive surface oriented at a drive angle that is different from 90° relative to said centerline, and a radial inner surface surrounding said centerline; and a center fill passage disposed in said metallic component and extending from said radial inner surface through said drive surface.

2. The drive plate of claim 1 wherein a portion of said center fill passage is a fill slot through said drive surface; and said fill slot following an arc having a substantially constant radius relative to said centerline.

3. The drive plate of claim 2 wherein said arc sweeps out an angle less than 180° about said centerline.

4. The drive plate of claim 2 wherein said metallic component includes a base surface located opposite said drive surface; and said metallic component defining a plurality of bearing supply passages extending from said base surface through said drive surface, and said bearing supply passages being distributed on a circle that includes said arc.

5. The drive plate of claim 1 wherein said center fill passage includes a supply slot extending radially outward from said radial inner surface and being contained within an angle of less than 180° about said centerline.

6. The drive plate of claim 1 wherein said metallic component includes a base surface separating said radial inner surface from a radial outer surface; and said base surface lies in a plane substantially perpendicular to said centerline.

7. The drive plate of claim 1 wherein said metallic component includes a base surface separating said radial inner surface from a radial outer surface;

said center fill passage including an arcuate shaped fill slot through said drive surface and a supply slot extending radially outward from said radial inner surface, and said fill slot and said supply slot being contained within an angle of less than 180° about said centerline; and said metallic component defining a plurality of bearing supply passages extending from said base surface through said drive surface.

8. The drive plate of claim 7 wherein said bearing supply passages and said fill slot being distributed on a circle centered on said centerline;

said base surface lies in a plane substantially perpendicular to said centerline; and said radial outer surface having a cylindrical shape.

9. A pump comprising:

a housing having an inlet;

a plurality of pistons each and being arranged around a centerline, having a hollow interior;

a rotatable drive plate having a radial inner surface having a supply opening; and said hollow interior of at least one of said plurality of pistons being in fluid communication with said inlet via said supply opening.

10. The pump of claim 9 including a barrel at least partially positioned in said housing adjacent one end of said plurality of pistons;

said plurality of pistons are oriented parallel to said centerline;

said drive plate having a drive surface positioned adjacent an opposite end of each of said plurality of pistons.

11. The pump of claim 9 wherein said drive plate has a base surface separated from said housing by a fluid thrust bearing; and said drive plate has a radial outer surface separated from said housing by a fluid journal bearing.

12. The pump of claim 9 wherein said drive plate defines a plurality of bearing supply passages extending between said base surface through said drive surface.

13. The pump of claim 9 wherein said drive plate defines a center fill passage, which includes said supply opening, extending from said radial inner surface through said drive surface.

14. The pump of claim 13 wherein a portion of said center fill passage is a fill slot through said drive surface; and said fill slot following an arc having a substantially constant radius relative to said centerline.

15. The pump of claim 14 wherein said center fill passage includes a supply slot extending radially outward from said radial inner surface; and said supply slot and said fill slot being contained within an angle of less than 180° about said centerline.

16. The pump of claim 9 wherein said drive plate includes a base surface separating said radial inner surface from a radial outer surface;

said drive plate defining a center fill passage including an arcuate shaped fill slot through said drive surface and a supply slot, which includes said supply opening, extending radially outward from said radial inner surface, and said fill slot and said supply slot being contained within an angle of less than 180° about said centerline; and said drive plate defining a plurality of bearing supply passages extending from said base surface through said drive surface.

17. The pump of claim 16 wherein said bearing supply passages and said fill slot being distributed on a circle centered on said centerline;

said base surface lies in a plane substantially perpendicular to said centerline; and said radial outer surface having a cylindrical shape.

18. A method of pumping fluid comprising the steps of:

reciprocating a plurality of pistons at least in part by rotating a drive plate;

fluidly connecting a pumping chamber of a portion of said pistons to an inlet via a center fill passage extending between a radial inner surface and a drive surface of said drive plate; and fluidly connecting a pumping chamber of a different portion of said pistons to an outlet.

19. The method of claim 18 including a step of adjusting an effective pumping stroke of said pistons at least in part by repositioning a plurality of sleeves surrounding different ones of said pistons.

20. The method of claim 19 including a step of positioning thrust bearing fluid between a base surface of said drive plate and a pump housing; and positioning journal bearing fluid between a radial outer surface of said drive plate and said pump housing.

* * * * *